US005133372A

United States Patent [19]

Seja et al.

[11] Patent Number: 5,133,372

[45] Date of Patent: Jul. 28, 1992

[54] HOT AIR HAIR CURLING APPARATUS

[75] Inventors: Frank Seja, Darmstadt; Rupert Zang, Grossostheim, both of Fed. Rep. of Germany

[73] Assignee: Wella Aktiengesellschaft, Darmstadt, Fed. Rep. of Germany

[21] Appl. No.: 499,541

[22] PCT Filed: Nov. 2, 1989

[86] PCT No.: PCT/EP89/01309

§ 371 Date: Jun. 22, 1990

§ 102(e) Date: Jun. 22, 1990

[87] PCT Pub. No.: WO90/04937

PCT Pub. Date: May 17, 1990

[30] Foreign Application Priority Data

Nov. 3, 1988 [DE] Fed. Rep. of Germany ..... 3837297

[51] Int. Cl.[5] ..... A45D 6/06

[52] U.S. Cl. ..... 132/228; 132/239; 132/266; 132/272

[58] Field of Search ..... 132/227, 228, 229, 233, 132/237, 238, 239, 266, 269, 271, 272, 119.1

[56] References Cited

U.S. PATENT DOCUMENTS

| | | | |
|---|---|---|---|
| 3,213,860 | 10/1965 | Mizell et al. | 132/238 |
| 3,265,075 | 8/1966 | Edman et al. | 132/227 |
| 3,750,680 | 8/1973 | Miller | 132/119.1 |
| 3,863,652 | 2/1975 | Scivoletto | 132/118 |
| 3,890,984 | 6/1975 | Lesetar | 132/271 |
| 3,894,547 | 7/1975 | Scivoletto | 132/118 |
| 4,023,578 | 5/1977 | Buhler | 132/269 |
| 4,327,753 | 5/1982 | Bertschi | 132/239 |
| 4,467,821 | 8/1984 | Stewart | 132/238 |
| 4,492,241 | 1/1985 | Thaler et al. | 132/229 |
| 4,664,132 | 5/1987 | Schillig | 132/271 |

FOREIGN PATENT DOCUMENTS

| | | |
|---|---|---|
| 0168099 | 1/1986 | European Pat. Off. . |
| 3119085 | 12/1982 | Fed. Rep. of Germany . |
| 3215232 | 10/1983 | Fed. Rep. of Germany . |
| 3529267 | 2/1987 | Fed. Rep. of Germany . |
| 2944050 | 4/1987 | Fed. Rep. of Germany . |
| 2419044 | 10/1979 | France . |

*Primary Examiner*—John J. Wilson
*Assistant Examiner*—Frank A. LaViola
*Attorney, Agent, or Firm*—Michael J. Striker

[57] ABSTRACT

Hot air hair curling apparatus (1) has a motor-driven hair curler body (2, 2') which is provided with retractable radially arranged teeth (3). The hair curler body (2, 2') is mounted with the apparatus (1) so as to be axially detachable by means of a clutch (4, 5) which can be provided as a catch clutch (5') or as a permanent magnet clutch (5), as desired. The hair curler body (2, 2') is connected with a shaft (24) axially at one end for high mechanical stability, which shaft (24) engages with a first and second bearing (16, 17). The shaft and remaining portion of the hair curler body are hollow and the shaft is provided with elongated throughgoing holes between the bearings so that heated air can flow into the hair curler body. The first bearing is larger than the second bearing which is closest to the motor. Accordingly, it is possible to exchange, clean or disinfect the hair curler body (2, 2') in a simple manner.

8 Claims, 2 Drawing Sheets

HOT AIR HAIR CURLING APPARATUS

BACKGROUND OF THE INVENTION

The invention relates to a hot air hair curling apparatus comprising a motor-driven hair curler body provided with radially arranged teeth.

Such an apparatus is known from DE-35 29 267 A1 and serves to shape hair curls, wherein a strand of hair is wound on the hair curler body in each instance by means of a motor. After a brief treatment period of the curl with hot air flowing from the curler body, the hair curler body is unlocked axially and unrolled from the curled hair accompanied by the application of tensile force of the curl. The arranged curl loses some of its resiliency due to this process, particularly if the curl is not yet conditioned at room temperature prior to being unrolled from the curler body.

SUMMARY OF THE INVENTION

The invention therefore has the object of providing an apparatus, according to the preamble of claim 1, which does not have the aforementioned disadvantage, which further provides multifold possibilities of use, and which is simple to handle and has great mechanical stability.

According to the invention the hair curling apparatus comprises a motor-driven hair curler body which is provided with radially-arranged, retractable teeth. The hair curler body is connected with a gear unit and motor so as to be axially detachable by a clutch, which may be a catch clutch or a permanent magnet clutch. The hair curler body has a shaft axially at one end for a highly mechanically stable mounting which engages with a first and second bearing.

The hair curler body can be drawn out of the hair curl axially. The hair curler body is provided with retractable teeth, so that this hair curl can be conditioned by the room temperature in its original shape. An optimal resiliency of the curl is accordingly achieved.

A particularly simple structure of a tooth retracting mechanism is provided. The hair curler body comprises an actuating element at its free end for the retraction of the teeth. Depending on the tooth retracting mechanism, the actuating element can be constructed so as to be actuable axially or radially as desired.

An advantageous added function is provided in that the actuating element is constructed as a dividing tip. Accordingly, a strand can be divided with the apparatus by means of the dividing tip. The dividing tip can be constructed so as to be axially or radially actuable, as desired, in order to actuate the tooth retracting mechanism.

Multifold possibilities of use and a simple handling of the hot air hair curling apparatus are provided in that the hair curler body is connected with the apparatus by a clutch so as to be axially detachable, so that the hair curler body can be exchanged quickly and simply, e.g. in order to use a hair curler body with a greater curler diameter.

A particularly simple handling for exchanging the hair curler body is provided in that the clutch is provided as catch clutch or permanent magnet clutch, so that a slip clutch, which prevents excessive transmission of torque, can be implemented simultaneously.

In order to compensate for radial tolerances between the shaft journal and the drive clutch disk, the latter is provided with a compensating device.

In order to provide a very high axial stability between the hair curler body and the hot air hair curling apparatus, the hair curler body is connected axially with a shaft at one end and engages with a first bearing in the vicinity of the hair curling body and with a second bearing of the hot air hair curling apparatus at the shaft journal. The forces acting transversely relative to the longitudinal axis of the hair curling body are distributed to the two bearings.

It is advantageous ,to provide the journal with a permanent magnet. Not providing the drive clutch disk within the hot air hair curling apparatus with a permanent magnet has the disadvantage that magnetizable parts inadvertently falling into the apparatus would be very difficult to remove from the apparatus and the operating reliability of the apparatus would accordingly be impaired.

In order to supply the curler body with hot air, the hair curler body and the shaft are constructed so as to be hollow except between the two bearings. The shaft is provided with elongated holes between the bearings, which elongated holes are arranged so as to be uniformly distributed radially. The hot air is guided through the elongated holes along the hollow shaft up to the hair curler body and can pass outward from the inside. In order not to cause a build-up of hot air within the apparatus when removing or exchanging the hair curler body, the first bearing is provided with a greater diameter than the second bearing. Built up hot air can accordingly flow through between the shaft journal and the first bearing in an unimpeded manner when guiding in or guiding out the shaft.

The exchangeability of the hair curler body also has the advantage that it can be cleaned and disinfected separately with easy handling or replaced due to defects.

BRIEF DESCRIPTION OF THE DRAWING

The objects, features and advantages of the present invention will now be illustrated in more detail by the following detailed description, reference being made to the accompanying drawing in which.

DETAILED DESCRIPTION OF THE INVENTION

Figure 1:
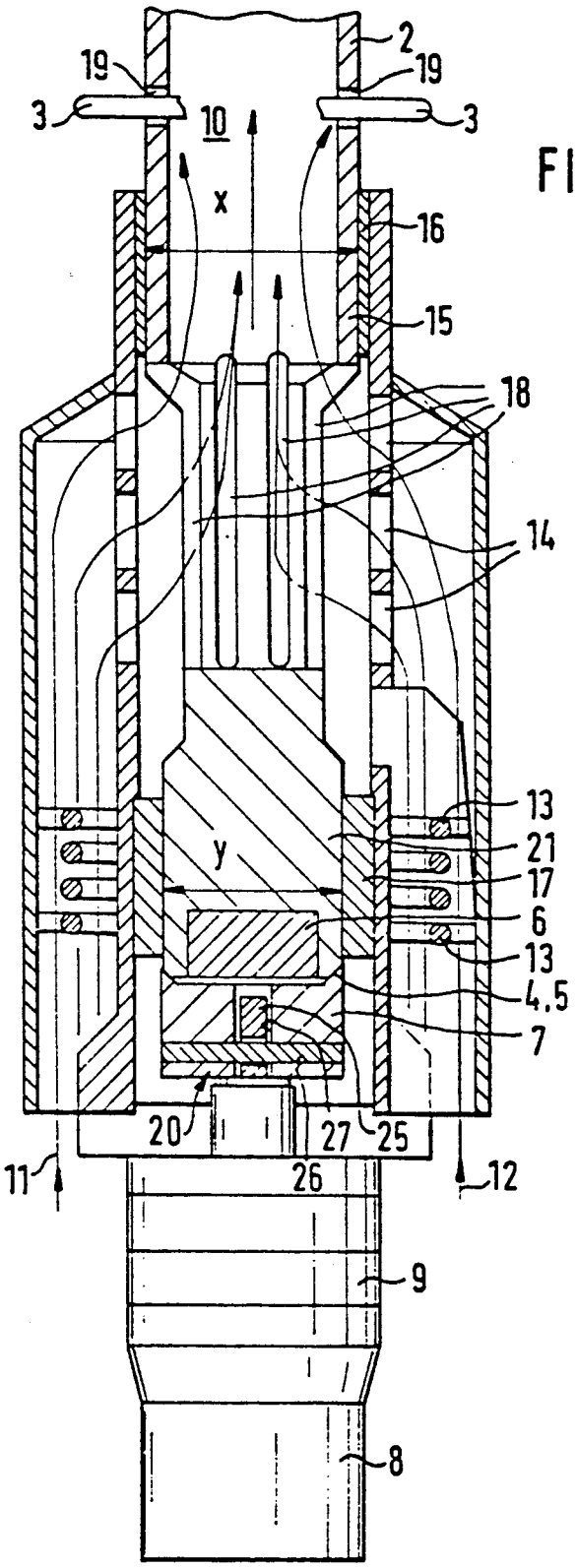
FIG. 1 is a partial cross sectional view through a hot air hair curling apparatus with a magnetic coupling.

A sectional view of the hot air hair curling apparatus 1, according to the invention, is shown in FIG. 1. The motor-driven hair curler body 2 is shown only in part. The tooth retracting mechanism is also omitted, since such a mechanism is already known in DE-29 44 050 A1 and is used in the embodiment of the invention shown here. At its free end, the hair curler body 2 comprises an actuating element, not shown in FIG. 1 (but see FIGS. 3 and 4), for retracting the teeth 3. The hair curler body 2 is releasably axially connected with a gear unit 9 and a motor 8 by a clutch or coupling 4'', so that the hair curler body 2 can be set in rotation. A catch clutch 5' or a permanent magnet clutch 5 can be provided as clutch 4, as desired. On the side of the hair curler body, the magnet clutch 5 comprises a shaft journal with an inserted permanent magnet 6 and a magnetizable clutch drive disk 7 which is constructed so as be shaped slightly in the manner of a hollow bell so as to provide a centering function. The clutch 5 is driven by means of a motor 8 and a gear unit 9. A hot air device, shown in part here, generates hot air 10 when the apparatus is operated, whose flow is shown by means of arrows 11 and 12. The cold air blown in at arrows 11, 12 is heated by means of the electrical heating coil 13 and flows through openings 14 and 18 into a hollow shaft 15 which is provided with elongated holes 18 between the two bearings 16, 17, which elongated holes 18 are arranged so as to be uniformly distributed radially, so that the hot air can reach the interior of the hollow hair curler body 2 and can exit through openings 19 and at the free openings 19 as well as the openings 19 equipped with a tooth 3. During this process, the cylindrical part of the hair curler body 2 (and, along with it, the strand of hair wound on the latter) is also heated.

The first bearing 16 has a greater diameter X than the second bearing 17 with a diameter Y.

The clutch 4, 5 is provided with a radial play compensating device 20, so that greater construction tolerances between the axes of the gear unit 9 and clutch drive disk 7 can be compensated for. For this purpose, the clutch drive disk 7 is provided with a fixed driving pin 26 transversely relative to the drive shaft 25, which driving pin 26 extends transversely through a bore hole 27 of the drive shaft 25 with some play. In order to remove the hair curler body 2 for the purpose of cleaning or exchanging, the latter can be separated from the clutch 4, 5 and removed from the apparatus by means of a slight axial force.

Figure 2:
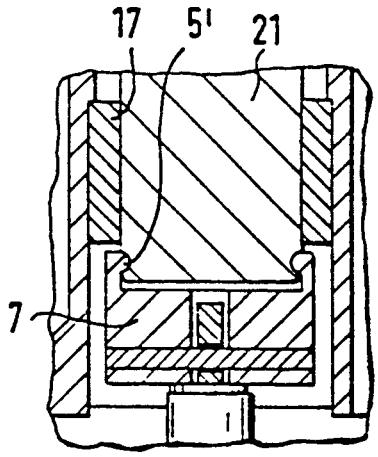
FIG. 2 is a cross sectional view through a catch clutch of another embodiment of the invention.

A corresponding catch clutch 5' is shown in section in FIG. 2.

Figure 3:
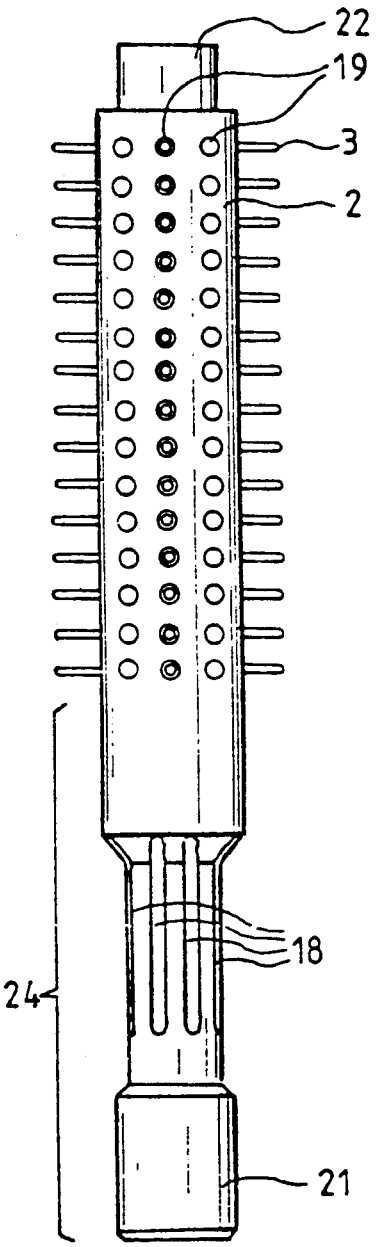
FIG. 3 is a side elevational view of the hair curler body.

FIG. 3 shows the complete hair curler body 2 with the shaft 24 in a side view. In order to retract the teeth 3 manually, the hair curler body 2 comprises an actuating element 22 which cooperates with a tooth retracting mechanism, not shown, in such a way that the teeth 3 can be retracted by means of a preferably axial displacement of the actuating element 22.

Figure 4:
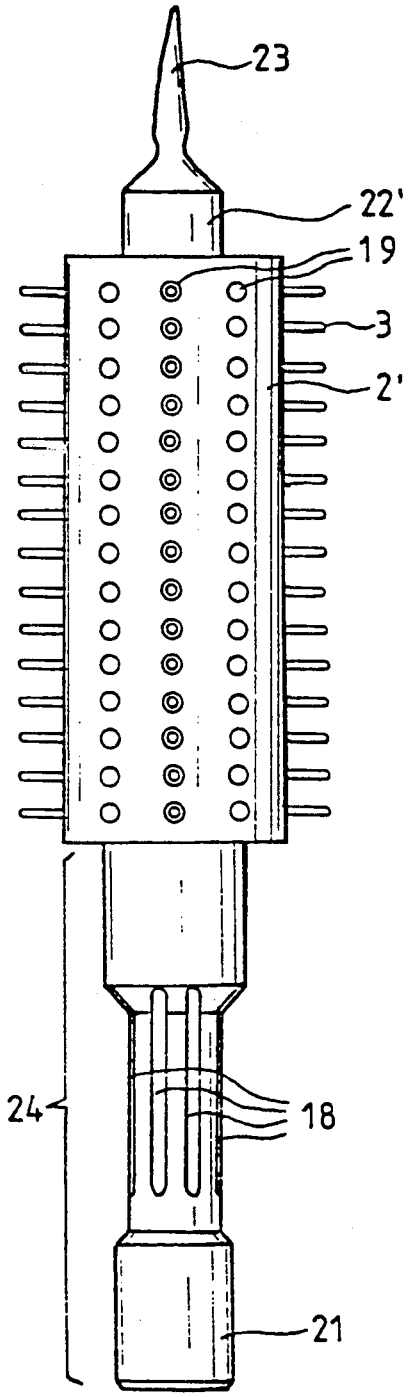
FIG. 4 is a side elevational view of another embodiment of hair curler body similar to FIG. 3, but with a greater curler body diameter and a dividing tip.

The hair curler body 2' according to FIG. 4 differs from the hair curler body 2 according to FIG. 3 in that the former has a greater curler body diameter and that the actuating element 22' is additionally provided with a dividing tip. In this respect, the dividing tip 23 is particularly suitable for an axial actuation for retracting the teeth 3.

It will be understood that each of the elements described above, or two or more together, may also find a useful application in other types of structures differing from the types described above.

While the invention has been illustrated and described as embodied in a hot air hair curling apparatus, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features, that from the standpoint of prior art, fairly constitute essential characteristics of the generic or specific aspects of this invention.

What is claimed is new and desired to be protected by Letters Patent is set forth in the appended claims.

1. A hot air hair curling apparatus comprising a motor; a motor-driven hair curler body connectable with said motor so as to be rotatable by said motor, said hair curler body having a free end and another end opposite from said free end, said hair curler body also having a shaft in the vicinity of the other end, said shaft having a shaft journal in the vicinity of said other end and a second bearing on said shaft journal and said shaft also having a first bearing spaced from said second bearing, said first bearing being of larger diameter than said second bearing, a plurality of radially disposed, retractable teeth associated with said curler body and means for moving said retractable teeth from a protruding position extended from said hair curler body and into a retracted position withdrawn within said hair curler body, said means for moving said retractable teeth including an actuating element located at said free end of said hair curler body for retracting said teeth into said hair curler body, and wherein said hair curler body is hollow and said shaft is provided with a plurality of elongated holes between said first and said second bearings, said elongated holes being uniformly distributed radially for admitting air so that air can flow into said curler body.

2. A hot air hair curling apparatus according to claim 1, wherein said actuating element is structured as a dividing tip for separating hair.

3. A hot air hair curling apparatus according to 1, further comprising a clutch connecting said motor with said hair curler body so that said hair curler body is axially detachable.

4. A hot air hair curling apparatus according to claim 3, wherein said clutch comprises a catch clutch.

5. A hot air hair curling apparatus according to claim 3, wherein said clutch comprises a permanent magnet clutch.

6. A hot air hair curling apparatus according to claim 5, wherein said shaft journal is provided with another permanent magnet in the vicinity of the other end of the hair curler body.

7. A hot air hair curling apparatus according to claim 3, wherein said motor has a motor drive shaft provided with a transverse throughgoing hole, and further comprising a radial play compensation device including a driving pin fixedly mounted in said clutch and extending transversely through the transverse throughgoing hole in said motor shaft with some play.

8. A hot air hair curling apparatus comprising a motor; a motor-driven hair curler body connectable with said motor so as to be rotatable by said motor, said hair curler body having a free end and another end opposite from said free end, said hair curler body also having a shaft in the vicinity of the other end, said shaft having a shaft journal in the vicinity of said other end and a second bearing on said shaft journal and said shaft also having a first bearing spaced from said second bearing, said first bearing being of larger diameter than said second bearing; a clutch connecting said motor with said shaft so that said hair curler body is axially detachable; a radial play compensation device including a fixed driving pin fixedly mounted in said clutch and extending transversely through the transverse throughgoing hole in said motor shaft with some play; a plurality of radially disposed, retractable teeth associated with said curler body, and means for moving said retractable teeth from a protruding position extended from said motor-driven hair curler body and into a retracted position withdrawn within said hair curler body, said means for moving said retractable teeth including an actuating element located at said free end of said hair curler body for retracting said teeth into said curler body, and wherein said hair curler body is hollow and said shaft is provided with a plurality of elongated holes between said bearings, said elongated holes being uniformly distributed radially for admitting air so that air can flow into said curler body.

* * * * *